US006941579B2

(12) United States Patent
Tanenbaum

(10) Patent No.: US 6,941,579 B2
(45) Date of Patent: Sep. 13, 2005

(54) ELASTIC FLAP WITH SLEEVE AND GLOVE FOR LIQUID IMPERVIOUS SEAL

(76) Inventor: Michael Tanenbaum, 1825 Calibre Woods Dr., Atlanta, GA (US) 30329

( * ) Notice: Subject to any disclaimer, the term of this patent is extended or adjusted under 35 U.S.C. 154(b) by 0 days.

(21) Appl. No.: 10/131,953

(22) Filed: Apr. 24, 2002

(65) Prior Publication Data

US 2003/0046748 A1 Mar. 13, 2003

Related U.S. Application Data

(60) Provisional application No. 60/286,270, filed on Apr. 25, 2001, now abandoned.

(51) Int. Cl.[7] ..... A41B 7/00

(52) U.S. Cl. ..... 2/123; 2/162; 2/161.7

(58) Field of Search ..... 2/209.13, 59, 69.5, 2/162, 170, 161.7

(56) References Cited

U.S. PATENT DOCUMENTS 3,657,741 A * 4/1972 Blanco ..... 2/59
4,389,734 A * 6/1983 Franz et al. ..... 2/59
4,399,567 A * 8/1983 Weon Joong ..... 2/161.6
5,033,115 A 7/1991 Bowling et al.
5,073,988 A 12/1991 Lewis, Jr. et al.
5,555,561 A 9/1996 Plachta et al.
5,572,743 A 11/1996 Yavitz
5,628,067 A 5/1997 Meyer et al.
5,682,616 A * 11/1997 Pisano ..... 2/239
5,924,130 A * 7/1999 Fragomeli ..... 2/16
5,978,960 A 11/1999 Wrightman
6,128,785 A 10/2000 Sommeregger
6,523,181 B2 * 2/2003 Medves ..... 2/161.6
6,530,090 B1 * 3/2003 Ambrose et al. ..... 2/59

* cited by examiner

*Primary Examiner*—Katherine Moran
(74) *Attorney, Agent, or Firm*—Daniel P. Dooley; Fellers, Snider, et al.

(57) ABSTRACT

A sleeve-glove attachment assembly for hazardous environments such as surgical or laboratory environments, as well as applications where there is a desire to maintain a fluid impervious seal such as water or snow activities, is provided to form a fluid impervious seal between a fabric sleeve, woven or nonwoven, and an elastic glove. The sleeve glove attachment assembly comprising an elastic flap, cylindrical in shape, having a distal end and proximal end is attached near the center of the flap to the sleeve at mid-forearm with the distal end extending over the sleeve cuff and proximal end extending over the sleeve toward the elbow. At least one of the proximal and distal ends comprising a raised geometric bead and frictional ridges on the outer surface eliminates bunching and channel formation between the glove cuff and sleeve. The glove cuff is placed over the geometric bead and frictional ridges of the distal end of the flap. Then the proximal end of the flap is folded over the distal end of the flap and overlying glove to create a continuous seal against fluids and particles. A method of making the device, method of donning the assembly, and method of removal of the assembly are also provided.

18 Claims, 8 Drawing Sheets

ELASTIC FLAP WITH SLEEVE AND GLOVE FOR LIQUID IMPERVIOUS SEAL

RELATED APPLICATIONS

This application claims benefit to U.S. Provisional application 60/286,270 originally filed on Apr. 25, 2001, now abandoned.

BACKGROUND OF THE INVENTION

In accordance with the invention a sleeve-glove attachment assembly is provided for protective garments used in hazardous environments such as surgical hospital settings and testing laboratories as well as garments desiring a waterproof seal at the sleeve-glove interface such as underwater diving suits, motorcycle gear, and snow skiing apparel. Also, the invention may be used at orifices of garments other than the wrist including the neck and ankles. However an immediate need is obvious in the surgical operating room setting, so reference to this application will be explained in detail.

This invention relates to the liquid barrier properties of surgical operating room personal protective equipment (PPE). The barrier properties are vital to the healthcare worker because of bloodborne infectious diseases and deadly viruses such as Hepatitis C and HIV. Conditions like Hepatitis C do not currently have vaccines and post-operation prophylaxis, often resulting in fatal consequences. The safety of the patient undergoing surgery may also become threatened if the liquid barrier garments of the caregiver are not sealed, especially at the fingers, hands, and wrists. Presently, surgical gowns and surgical gloves exist that provide safe liquid barriers as independent devices. However, the surgical glove-gown sleeve interface is the weakest link of all PPE because the glove and gown do not form a complete uniform seal.

In developing a solution to the glove-gown sleeve interface problem, one must understand the procedures of the operating room, constraints of the surgeons, and how PPE is donned.

PPE must not interfere with procedures performed by surgeons and their assistants. PPE should provide: maximum view of the surgeon's hands, maximum ventilation, non-limited sizing, fast time to don and remove, acceptable hoop stress/pressure at hands and wrists, and prevent penetration of infectious or undesirable fluids such as blood, urine, and other bodily fluids.

The surgeon and assistant nurses typically wear a reusable woven fabric or disposable nonwoven fabric gown. The sleeve of the surgical gown is baggy to allow free movement of the user's arms. The end of the sleeve, the stockinet, is typically manufactured with an absorbent material that performs two functions. First, the stockinet provides a comfortable layer that contacts the skin. Secondly, the stockinet is worn around the base of the hand tightly under the glove to provide a means of stabilizing the gown and glove interface during surgery. The surgical gloves are made of elastic synthetic or natural rubber latex. Other PPE includes face shields, masks, goggles, and shoe covers.

After scrubbing, the surgeon dons the surgical gown. The hands remain inside the gown sleeve while an assistant opens the glove cuff opening. The surgeon then pushes his or her hand into the glove, then immediately pushing the hand through the stockinet and into the fingers of the glove. The assistant nurse would then pull the cuff of the surgical glove proximally toward the forearm over the baggy gown sleeve material.

The constriction of the glove cuff (3') compresses the gown sleeve (2') against the user's forearm (1') creating channels (4') that allow blood to pass through. These channels make the glove-gown sleeve interface the weakest link in surgical PPE. FIG. 19 illustrates the channels.

SUMMARY OF THE INVENTION

The present invention provides a sleeve-glove attachment assembly, which forms a liquid or fluid impervious seal between a fabric sleeve, woven or nonwoven, and elastic glove. The sleeve-glove attachment assembly, cylindrical in shape, described herein as a flap or tube having a distal end and proximal end is attached near the center of the flap to the sleeve at mid-forearm with the distil-end extending over the sleeve cuff and proximal end extending over the sleeve-close to the elbow. At least one of the proximal and distal ends comprising a raised geometric bead and frictional ridges on the outer surface eliminates bunching and channel formation between the glove cuff and sleeve. The glove cuff is placed over the geometric bead and frictional ridges of the distal end of the flap. Then the proximal end of the flap is folded over the distal end of the flap and overlying glove to create a continuous seal against fluids and particles. The interface may comprise one geometric bead, a bead and at least one frictional ridge, multiple geometric beads, multiple geometric beads and multiple frictional ridges. The ridges and beads may be strategically placed on one or both of the distal and proximal ends of the flap to create a single continuous seal or an interlocking mesh of beads and ridges. A method of making the invention, method of donning, and method of removal of the assembly is also provided.

An object of the invention is to provide a liquid or fluid impervious seal to prevent fluids or particles from passing through the interface of a glove and sleeve interface by creating a smooth and continuous seal wherein no sleeve or glove channels allow fluids to pass through the interface.

A further object of the invention is to minimize time during donning of a sleeve and glove, provide comfort, breathability, and dexterity to the wearer of the glove and sleeve.

A further object of the invention is to provide a method of making a device of the present invention.

A further object of the invention is to provide a method of donning the present invention to prevent fluids or particles from passing through the interface of a glove and sleeve interface.

A further object of the invention is to provide a method of removing a sleeve-glove assembly of the present invention to prevent fluids or particles from reaching the skin of the user during removal.

DESCRIPTION OF FIGURES

The present invention and its advantages may be understood by reference to the detailed description section when read with the accompanying drawings briefly described below.

DETAILED DESCRIPTION

Figure 1:
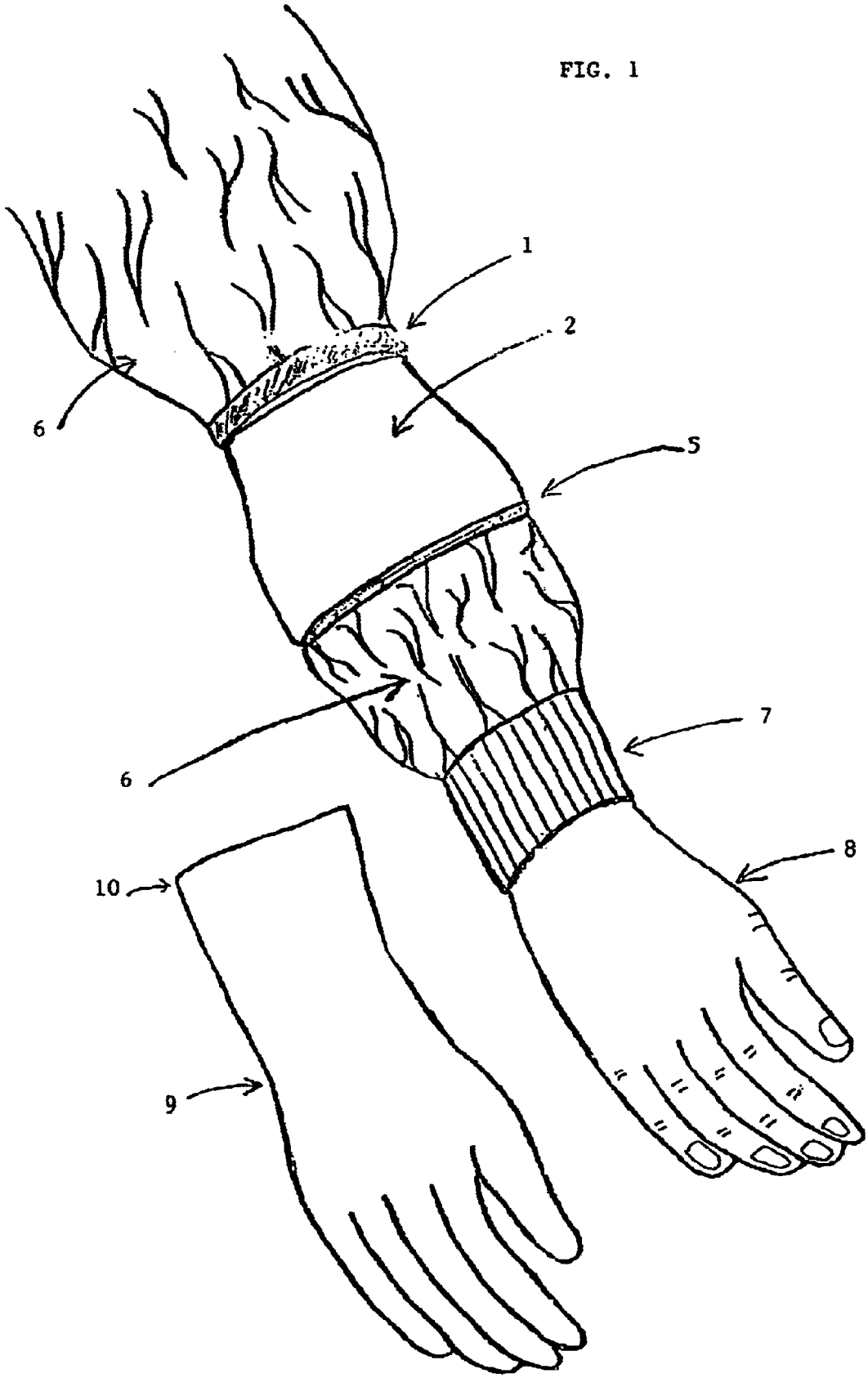
FIG. 1 shows a person wearing a baggy sleeve currently used with one embodiment of the invention, or flap attached to the sleeve. The elastic flap is pulled back over the forearm during donning. A glove is also shown to the side.
Figure 2:
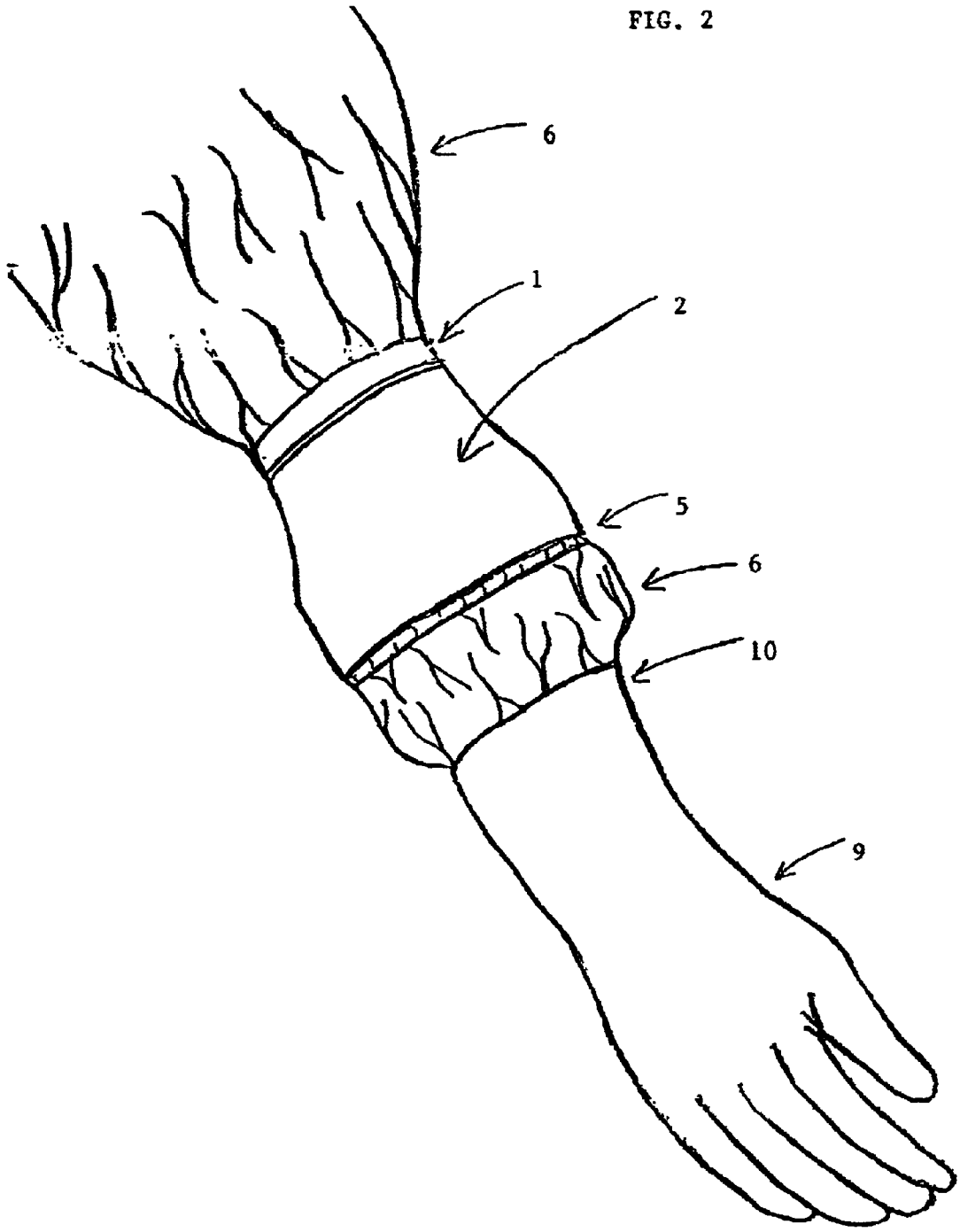
FIG. 2 shows the assembly of FIG. 1 wherein the glove has been donned.
Figure 3:
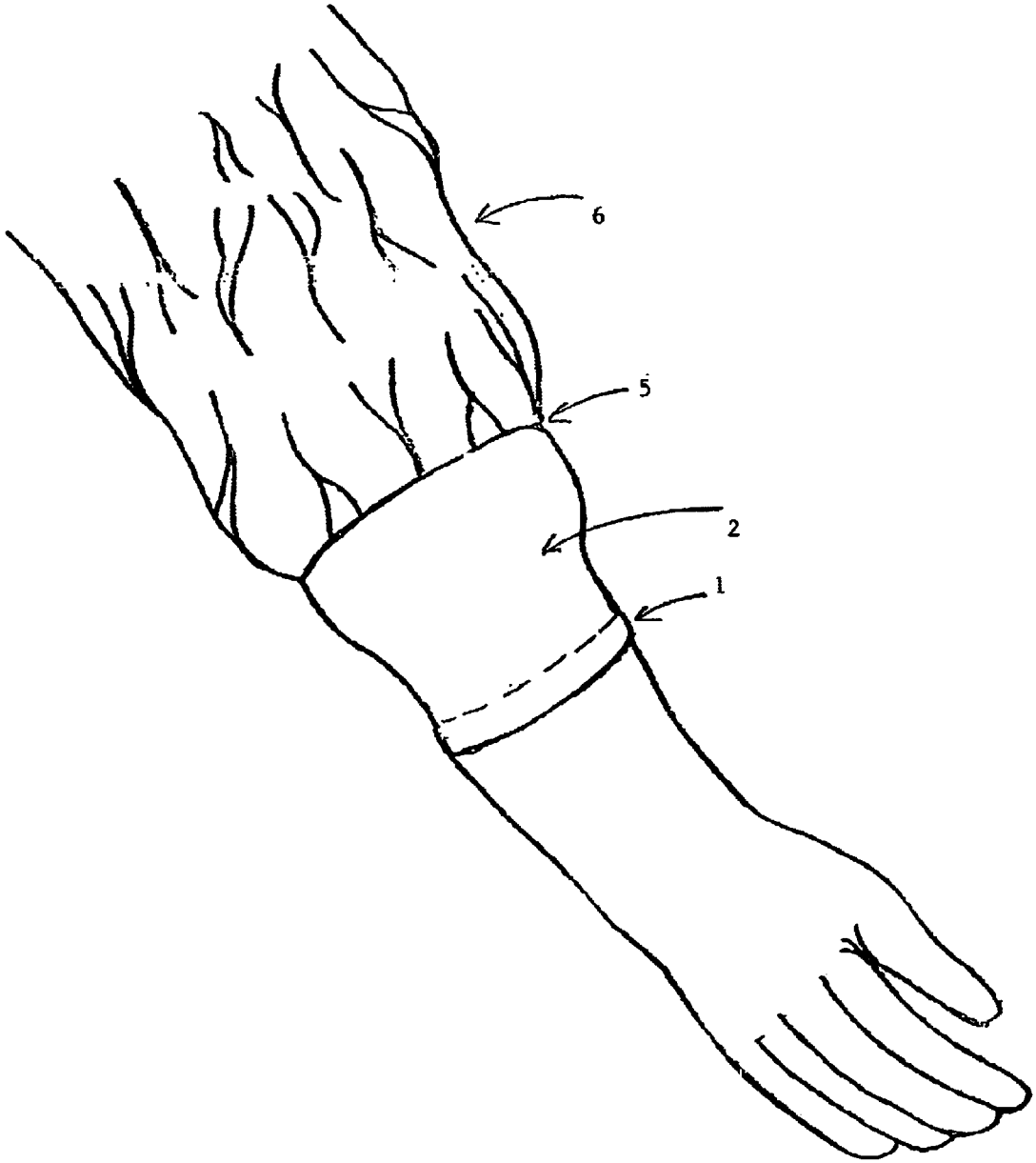
FIG. 3 shows the assembly of FIGS. 1 and 2 wherein the flap has been folded over the glove cuff.

FIGS. 1–6 show a first embodiment of the invention. As shown in FIG. 1, a sleeve (6), (also referred to herein as a cuffed limb covering portion (such as 6)), has an elastic pullover flap (2) attached to the sleeve by at least one circumferential location. The flap may be attached by any known method in the art such as heat bonding, sewing, adhesives, or combination thereof. The user dons the garment that includes the elastic pullover flap (2) in the pulled back position as shown in FIG. 1. The adhesion point of the pullover flap (5) is shown. Typically the sleeve cuff, commonly known as the stockinet (7) is donned at the base of the hand (8). A glove (9), (also referred to herein as a limb extremity covering member (such as (9)), is shown to the side of the hand (8). A geometric bead (1) is positioned near the end of the pullover flap (2) to increase the impervious properties of the seal when the flap is folded over a glove cuff (cuff) (10), (also referred to herein as a limb extremity covering member cuff (such as (10)). Preferably the geometric bead comprises an elastic material FIG. 2 shows a second step of the first embodiment wherein the glove (9) is donned over the stockinet (7). After donning, the cuff (10) end is located proximal to the stockinet (7) visible in FIG. 1. The pullover elastic flap (2) is then folded about the attachment point (5) of the flap (2), as shown in FIG. 3, to completely cover the cuff (10) shown in FIG. 2. The resulting assembly is an innermost sleeve layer (6), cuff (10) surrounding the sleeve layer (6), and outermost elastic flap (2).

Figure 4:
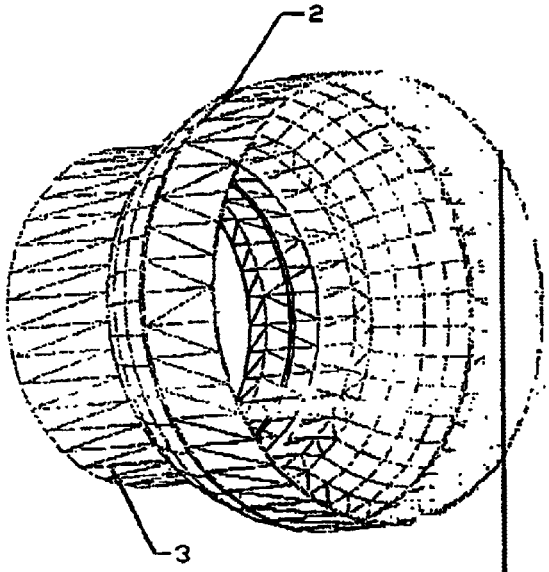
FIG. 4 is a three dimensional CAD drawing of the flap of FIGS. 1–3 viewed from the end attached to the sleeve.
Figure 5:
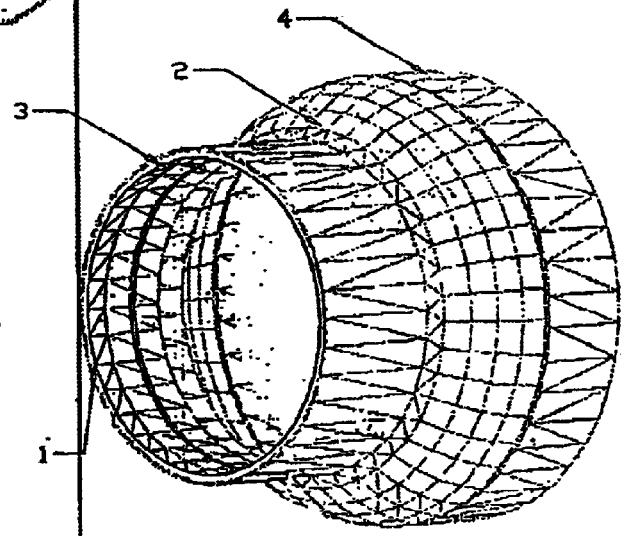
FIG. 5 is a three dimensional CAD drawing of the flap of FIGS. 1–3 viewed from the distal end covering the cuff of the glove.

FIGS. 4 and 5 show three-dimensional views of the elastic pullover flap (2) of FIGS. 1–3. Herein, proximal end refers to the proximal end of the flap before any folding steps. FIG. 4 shows the opening of the proximal end of the elastic flap (4). The circumference of the proximal end of the pullover elastic flap (4) is larger than the distal end of the pullover elastic flap (3) because the proximal end must be adhered to the sleeve when fully expanded. The larger circumference prevents creation of pores that may allow fluids or particles to pass through. Therefore the circumference of the proximal end should be large enough such that unnecessary expansion is not required when attaching the flap to the sleeve. The circumference of the distal end of the pullover elastic flap (3) is smaller to more closely match the circumference of the user's wrist. Preferably the distal end circumference is smaller or substantially equal to the wrist circumference so that the distal end expands to create a continuous seal void of channels or bunching of the interface materials. However, depending on the amount of excess sleeve material that would accumulate under the interface of the invention, it may be desirable to select a circumference larger than the wrist of the user to prevent unnecessary expansion of the flap.

Figure 6:
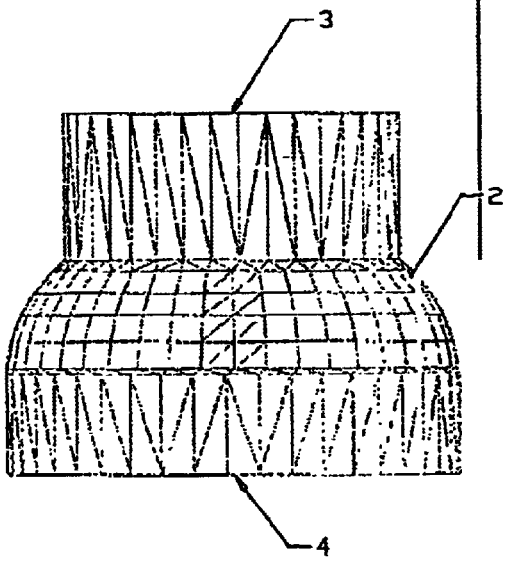
FIG. 6 shows the profile of the flap of FIGS. 1–3.

The profile of the flap (2) is shown in FIG. 6. The central portion of the flap may taper in a curved (shown) or straight manner. FIG. 5 shows the rectangular geometric bead (1) placed on the inside surface of the distal end of the elastic pullover flap (2).

Figure 7:
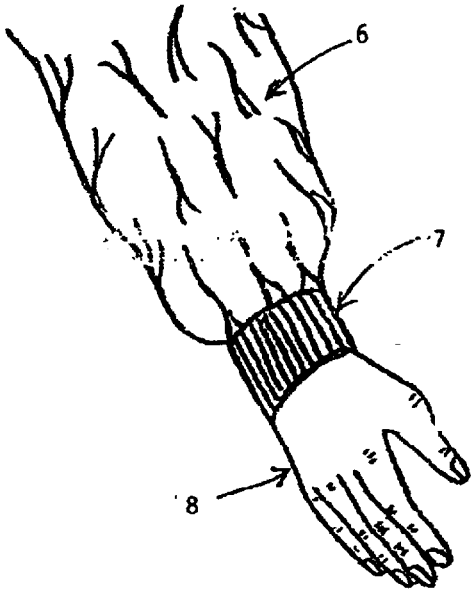
FIG. 7 shows a person wearing a baggy sleeve with an elastic fabric cuff.

FIGS. 7 through 10 show donning steps of a second embodiment of the invention. FIG. 7 shows a person with an unmodified sleeve (6) pulled over the arm and terminating at the base of the hand (8).

Figure 8:
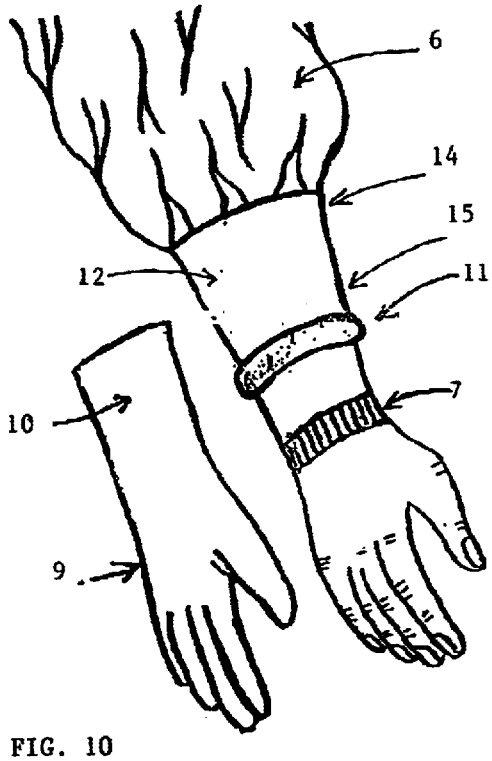
FIG. 8 shows a second embodiment of a flap attached to a baggy sleeve. A glove is shown to the side. The elastic flap is adhered to the sleeve at a point near the center of the flap.
Figure 18:
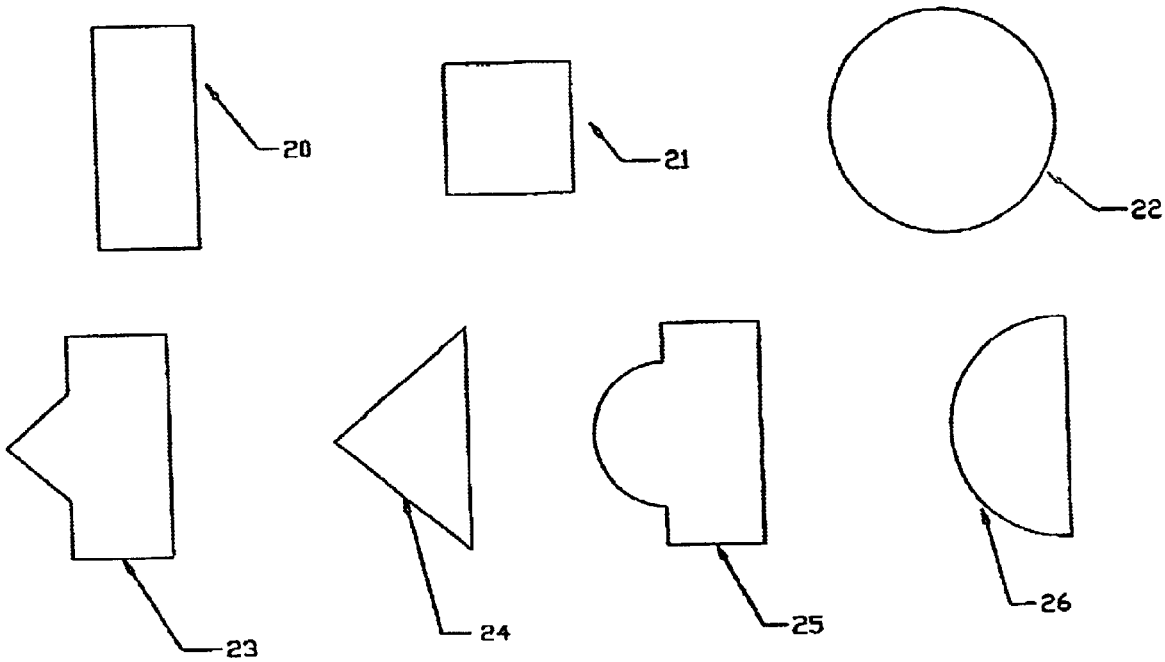
FIG. 18 shows possible profiles for the geometric bead of all embodiments of the invention.

FIG. 8 shows a similar sleeve (6) having an elastic folding flap (12) attached to the sleeve by at least one attachment location. Preferably one attachment point is located near the middle of the longitudinal length of the flap (15). A second attachment point may be located near the stockinet (7) to prevent the distal end of the flap from moving out of position. Any-suitable means of attachment as described with the first embodiment may be used. The elastic folding flap includes a geometrical bead (11) on the outer surface near the distal end of the flap, and material (36) and (37) extending from the Geometrical bead (11). The geometrical bead (11), the material (36), and the material (37) collectively forms a profile (38) of a retention region (35). The profile shape of the geometrical bead in FIGS. 8 through 11 is a semicircle, although other profiles of the bead may be used as is shown in FIG. 18. A glove (9) is shown in FIG. 8 to represent the extent at which the cuff (10) reaches when donned over the elastic folding flap (12). Notice that the cuff (10) will be donned just beyond the geometric bead on the distal end of the elastic folding flap (12).

Figure 9:
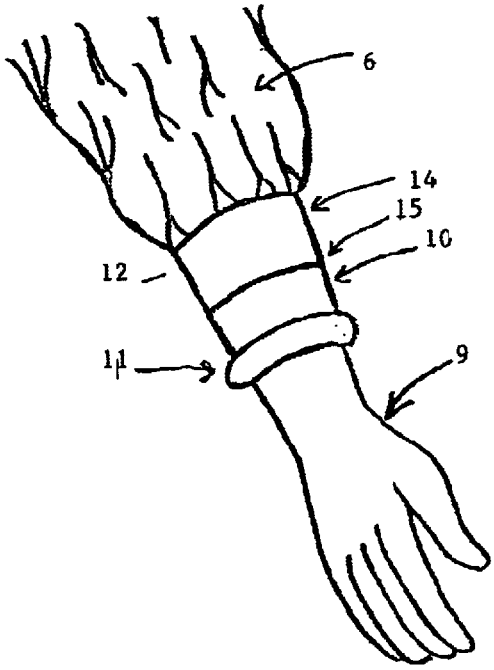
FIG. 9 shows a glove donned over the distal end of the flap of FIG. 8.

FIG. 9 shows the glove (9) donned over the elastic folding flap (12). The geometric bead (11) on the elastic folding flap (12) expands the circumference of the donned cuff (10) so that the cuff (10) smoothly conforms to the shape of the geometric bead. The smooth conformation and contracting force of the cuff (10) creates a tight, continuous, and uniform seal. During this step the proximal end (14) of the elastic folding flap (12) remains in the pulled back position. The final step requires the proximal end (14) of the elastic folding flap (12) to be folded over the cuff (10) about the attachment point (15) located near the middle of the flap.

Figure 10:
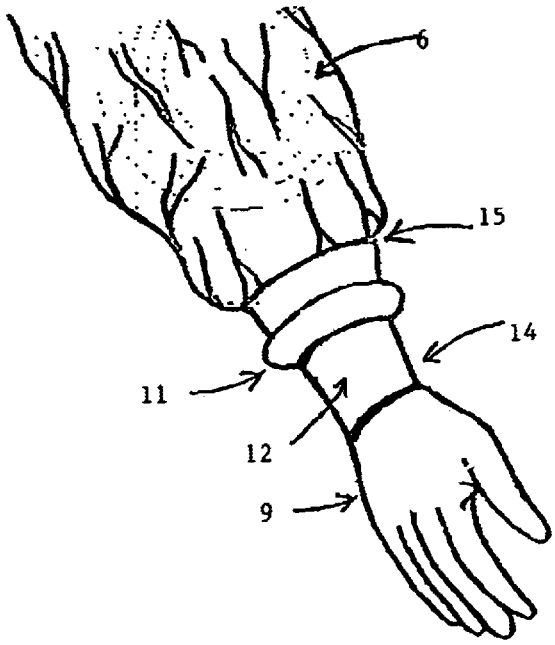
FIG. 10 shows the proximal end of the flap pulled over the glove cuff creating the fluid impervious seal.

FIG. 10 shows the proximal end (14) of the elastic folding flap (12) folded over the cuff (10), which is now hidden from view. The adhesion point (15) is now the most proximally located section of the elastic folding flap (12). Notice that the elastic folding flap (12) conforms smoothly over the cuff (10) and geometric bead (11) eliminating bunching and channel formation of material at the interface. In other words, the elastic folding flap (12) is elastically expansive in both a peripheral and longitudinal direction as shown by directional elasticity vectors (29) and (30) respectively. Because the elastic folding flap (12) is elastic, it constricts on the cuff (10) and geometric bead (11) to further increase the pressure of the fluid impervious seal. When using geometric beads 23 or 24 of FIG. 18, the seal and pressure is confined to a circumferential line or circle.

Figure 11:
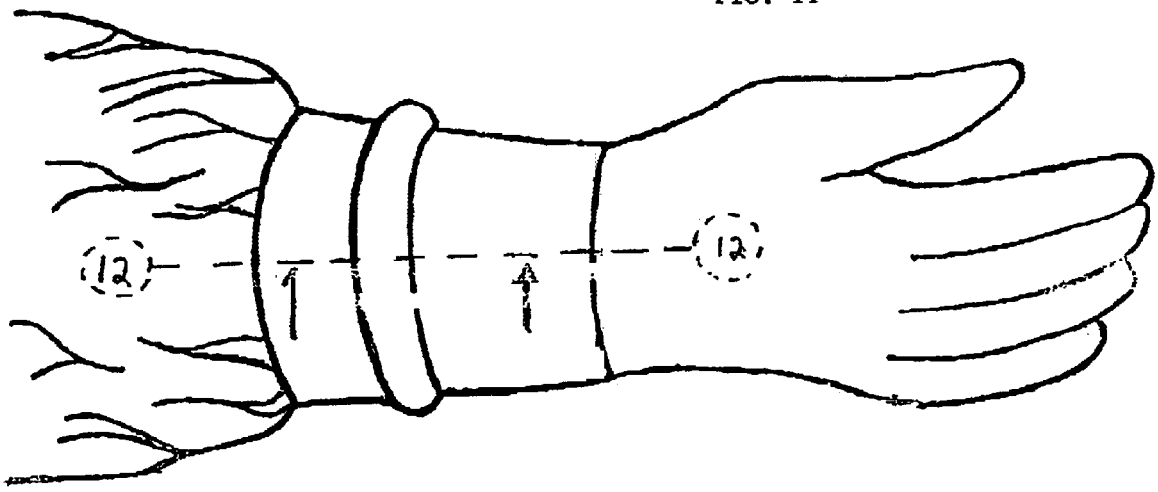
FIG. 11 is an enlarged view of FIG. 10.
Figure 12:
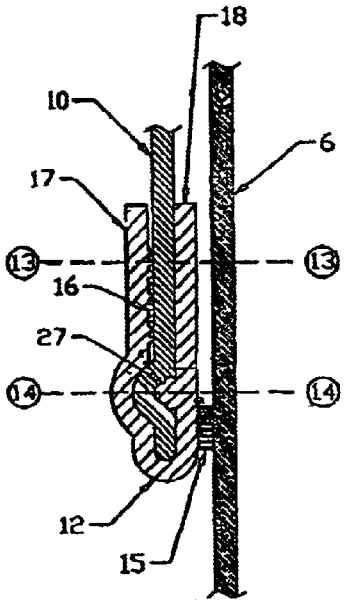
FIG. 12 is the cross section 12—12 of FIG. 11 viewed perpendicular to the longitudinal axis of the sleeve showing how the sleeve, flap, and glove interface.

FIG. 12 is the cross section view of FIG. 11. Only one side of the cross section is shown. It is to be understood that the opposite side would be the exact mirror image of FIG. 12. The arm of the user would reside to the right of the shown cross section in FIG. 12, and the assumed mirror image of FIG. 12 would be shown to the right of the arm of the user.

FIG. 12 shows the interface of the elastic folding flap (12) in conjunction with the cuff (10) and sleeve (6). Also shown is one of the preferred adhesion locations (15) between the elastic folding flap (12) and sleeve material (6). Adhesion may be accomplished by heat bonding, sewing, adhesives, or combination thereof that would not damage the integrity of either material and provide a liquid impervious seal. The cross sectional profile of the flap in FIG. 12 shows that the elastic folding flap forms a V-shape when folded and the cuff (10) resides in the middle of this V-shaped flap. Although the elastic folding flap is one part, it will now be described as an outer layer (17) and an inner layer (18) for clarity. FIG. 12 also shows a different style of geometrical bead (27) from the semicircular geometrical bead (11) shown in FIGS. 8 through 11. The geometrical bead (27) of FIG. 12 has a profile that comprises a semicircle resting on a rectangle, wherein the rectangle corners have a radius of curvature to remove any sharp angled edges. It should be noted that proper selection of the shape of the geometrical bead to match chosen materials is a crucial aspect of the seal. The shape is selected to allow the greatest fluid impervious seal, while preventing possible damage to the outer elastic layer (17) and cuff (10). Also shown in FIG. 12 is the addition of multiple rectangle beads, or ridges (16), that encircle the circumference of the inner surface of the outer layer (17) of the elastic folding flap (12). Preferably the selected elastic materials are durable enough to resist tearing so that bead profiles (23) or (24) may be used. However, the other profiles shown in FIGS. 12 and 18 have been shown to be satisfactory as well.

Additionally, FIG. 12 shows a pivot location (31) about which the elastic folding flap (12) may turn back over the limb extremity covering member cuff (10) of the limb extremity covering member (9) (of FIG. 10), and a sealing member (32) securing to the cuffed limb covering portion (6) to the elastic folding flap (12). Collectively, the cuffed limb covering portion (6) in conjunction with the sealing member (32), the elastic folding flap (12), and the limb extremity covering member cuff (10) of the limb extremity covering member (9) form a seal portion (33) of a garment (34), (also referred to herein as a surgical gown (34)).

Returning to FIG. 8, as shown therein, the cuffed limb covering portion (6) including the stockinet (7), together with the elastic folding flap (12) providing the geometric bead (11), in conjunction with the sealing member (32) (of FIG. 12) securing the elastic folding flap (12) to the limb covering portion (6), provide the retention region (35). (shown in greater detail by FIG. 12), proximal from the stockinet (7). It is noted that, with the elastic folding flap (12), including the geometric bead (11), secured to the cuffed limb covering portion (6), the retention region (35) presents a profile that precludes an unintentional movement of the limb extremity covering member (9) back over the retention region (35) once the limb extremity covering member (9) has been pulled over the retention region (35). The retention of the limb extremity covering member (9) adjacent the retention region is accomplished by a frictional force developed by an interaction between the limb extremity covering member (9) and the elastic folding flap (12), including the geometric bead (II) when the limb extremity covering member (9) is donned by the wearer and pulled at least partially over the retention region (35) (as seen in FIG. 9). Further friction is accomplished by at least a second bead or ridge (16) when the proximal end (14) of the flap is folded over the cuff (10) as shown in FIGS. 9–10 and 12.

Figure 13:
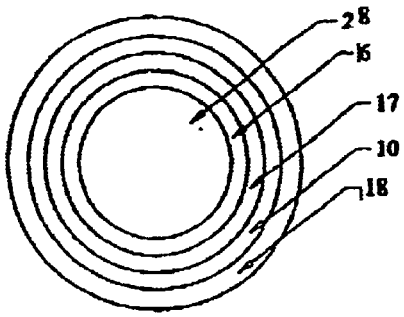
FIG. 13 is the cross section 13—13 of the donned assembly of FIG. 12 in the direction of the longitudinal axis of the arm.
Figure 14:
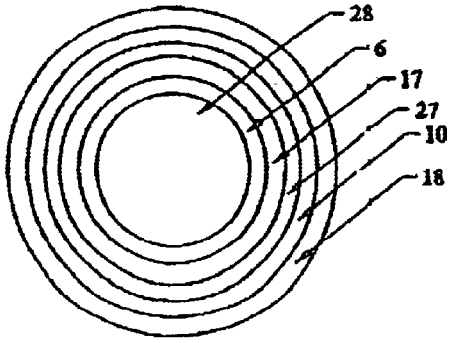
FIG. 14 is the cross section 14—14 of the donned assembly of FIG. 12 in the direction of the longitudinal axis of the arm including the geometrical bead on the outer surface of the distal end of the flap.

FIGS. 13 and 14 show cross sections looking down the longitudinal axis of the sleeve (6) as shown in FIG. 12. The adhesion point is not shown in these cross section views and the thickness of each layer is only for generalized graphical representation. It should be noted that varying thickness of any of the layers (6, 17, 27, 10, and 18) to increase stiffness or modify other properties of sections of the interface would not depart from the spirit of the invention. The central openings of FIGS. 13 and 14 represent the wrist of the user (28). FIG. 14 is the cross section located at the geometrical bead (27) on the elastic folding flap (12) of FIG. 12. Therefore the added thickness of FIG. 14 versus FIG. 13 is the geometric bead (27) on the inner layer (18) of the elastic folding flap. It is noted that, the geometric bead (27) is shown by FIG. 14 to be continuous and circumferentially extending around the sleeve (6).

Figure 15:
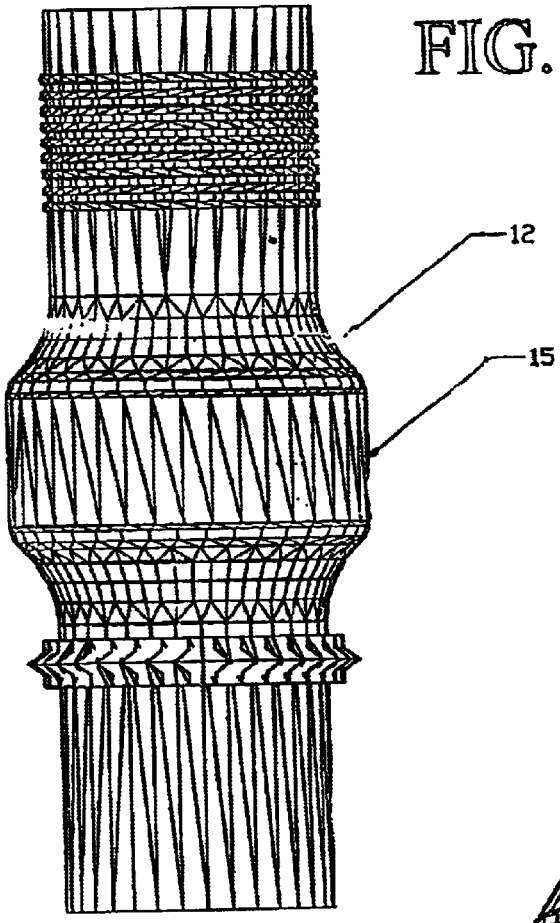
FIG. 15 is a profile view of the flap of FIGS. 8–14 utilizing one adhesion point in the center, a geometric bead consisting of a combination of a triangle and rectangle, and ridges to increase friction.
Figure 16:
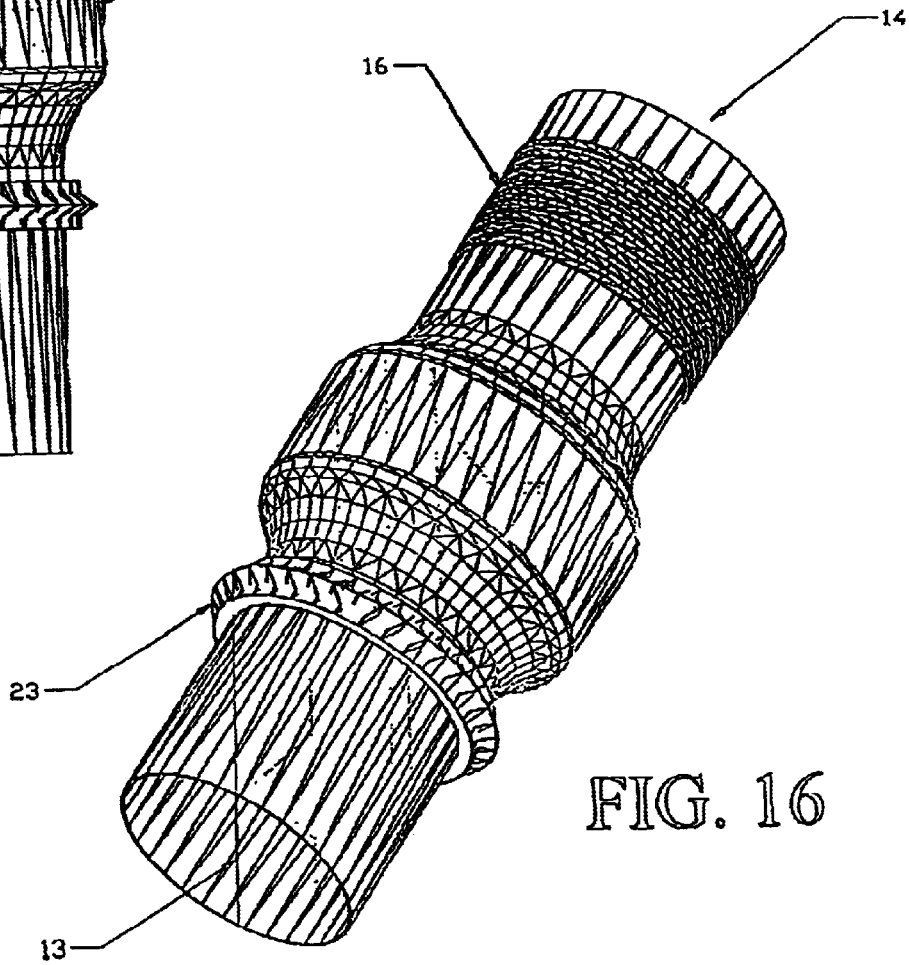
FIG. 16 is an angle view of the elastic flap shown in FIG. 15.

FIG. 15 shows the profile of the embodiment of the invention shown in FIGS. 8–12 before the elastic folding flap (12) is attached to the sleeve. The attachment point (15) is located near the center where the circumference is the greatest. This circumference may vary depending the circumference of the sleeve, which the flap is to be used with. This circumference should range between from 10 cm to 60 cm. FIG. 16 shows FIG. 15 at an angle so that it is clear that the elastic flap is a thin hollow shell or tube. The circumference of the distal end (bottom of FIG. 15) and proximal end (top of FIG. 15) is selected similarly as described with the first embodiment. The ridges (16) are shown most clearly in FIGS. 15 and 16. The profile of each ridge (16) could be composed of numerous shapes as shown in FIG. 18 to increase friction between the layers resulting in reduced opportunity for the assembly to separate during use. When the proximal end of the elastic folding flap (14) is folded over the glove cuff and distal end of the elastic folding flap (13), the ridges serve to grip on the glove cuff to prevent the sleeve from sliding out of the glove. This is more clearly shown in FIG. 12. The geometric bead (23) of FIGS. 15 and 16 is shown in greater detail in FIG. 17 and in the profile view (23) of FIG. 18.

Figure 17:
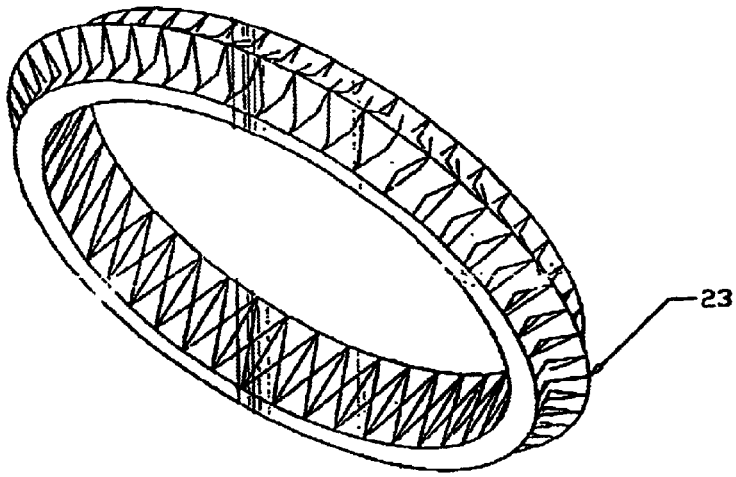
FIG. 17 is another embodiment of the invention wherein a geometric bead may be placed over the flap or used alone with only a sleeve and glove.

FIG. 17 shows that the geometric bead (23) could serve as a separate component to the elastic folding flap (12) or elastic pullover flap (2) rather than being formed integral with the folding flap or pullover flap. In addition, it is contemplated that the geometric bead of FIG. 17 may be used alone with a sleeve and glove to create an impervious seal. In this embodiment the geometric bead may be considered a band that can be attached or detached from the sleeve depending on the characteristics of the sleeve. However, as with all embodiments of the invention, a uniformly continuous seal must be present between the bead and sleeve, bead and glove, flap and sleeve, or flap and glove to prevent fluids and particles from passing through the interface.

FIG. 18 shows cross sectional profiles of the possible geometric bead shapes for all embodiments described above. The shapes comprise a rectangle (20), square (21), circle (22), rectangle-triangle combination (23), triangle (24), circle-rectangle combination (25), and a semicircle (26). The preferred profile is the triangle-rectangle combination (23) shown in FIGS. 15 through 17. Depending on durability of the flap and glove materials it may be desirable to reduce sharp angled edges by providing curvature to each edge.

The components of the invention described above may be made by processes known in the art such as extruding, molding dipping, or combinations thereof.

The components of the invention described above may comprise any known materials exhibiting elastic and impermeable properties such as polytetrafluoroethylene, silicone, natural and synthetic elastomers such as latex, or a combination thereof. The fluid impermeability characteristics of the flap and bead should be equal to or greater than the glove and gown. Furthermore, the materials may comprise coatings or impregnation of drugs to kill bacteria or microorganisms on contact.

While preferred embodiments have been shown, it will be understood that the invention is capable of numerous modifications, rearrangements, and substitution of parts without departing from the uniqueness of this invention as set forth in the claims section of this application. Although described in detail for hazardous environment applications such as surgery, this invention may be used with other garments to be used for various applications such as skiing, rain gear, motorcycle apparel, general laboratory garments, and underwater diving garments.

What is claimed is:

1. A method for donning personal protective equipment to create a water resistant interface between a glove and gown sleeve comprising the steps of:

a. donning a gown comprising first and second sleeves and first and second elastic flaps having distal and proximal edges, wherein the first and second flaps are attached to the first and second sleeves respectively at a point other than the proximal edges;

b. donning a glove having a proximal cuff, such that the proximal cuff envelops the distal edge of said first flap; and c. folding the first elastic flap by repositioning said proximal edge near the distal edge of said flap whereby the proximal edge of said flap envelops the proximal cuff of the glove.

2. The method of claim 1 wherein said method creates a water resistant interface between the glove and the gown sleeve.

3. The method of claim 1 further comprising, during the step of donning a glove, extending the proximal cuff of the glove beyond the distal edge of said flap.

4. The method of claim 1 wherein the first and second flaps comprise a geometric bead on an exterior surface of said flaps, further comprising: extending the proximal cuff to envelop the geometrical bead.

5. The method of claim 4 wherein said geometrical bead expands the proximal cuff of said glove and inhibits buckling of the proximal cuff.

6. A garment for a wearer comprising a cuffed limb covering portion supporting a retention region proximal a stockinet of the cuffed limb covering portion, the retention region comprising a profile such that a limb extremity covering member pulled over the retention region is prevented from unintentional movement back over the retention region, wherein the stockinet is provided at a distal end of the cuffed limb covering portion, and in which the retention region further comprises a bead and a material extending from the bead, wherein the material extending from the bead increases friction between the limb covering portion and the limb extremity covering member.

7. The garment of claim 6, in which the retention region is a segment of the limb covering portion and wherein the profile is a raised profile.

8. The garment of claim 7, in which the limb covering portion is a sleeve and in which the retention region comprises a bead circumferentially extending about the sleeve and the limb extremity covering member is a glove.

9. The garment of claim 8, in which the bead increases friction between the sleeve and glove thereby preventing the sleeve from unintentionally separating from the glove.

10. The garment of claim 9, in which the bead encircles the sleeve.

11. The garment of claim 6, in which the material extending from the bead comprises a second bead.

12. The garment of claim 6, in which the limb extremity covering member interlocks with the bead to form a liquid impervious seal to prevent fluids or particles from passing therebetween.

13. The garment of claim 12, in which the limb covering portion is a sleeve and in which the retention region comprises a bead circumferentially extending about the sleeve and the limb extremity covering member is a glove.

14. The garment of claim 13, in which the bead increases friction between the sleeve and glove thereby preventing the sleeve from unintentionally separating from the glove.

15. The garment of claim 14, in which the bead encircles the sleeve.

16. The garment of claim 15, in which the garment is a surgical gown.

17. A combination comprising:

a. a cuffed limb covering portion supporting a retention region with a profile, the retention region proximal from the cuff;

b. a limb extremity covering member pulled over the retention region, the profile of the retention region preventing unintentional movement of the limb extremity covering member back over the retention region, and c. a seal portion which forms a liquid impervious seal that prevents fluids or particles from passing between the cuffed limb covering portion and the limb extremity covering member by steps for donning personal protective equipment to create a water resistant interface between the cuffed limb covering portion and the limb extremity covering member, in which the seal portion comprises a sealing member secured to the cuffed limb covering portion, and an elastic folding flap providing a bead, wherein the elastic folding flap is secured to the sealing member.

18. The combination of claim 17, in which the bead is a first bead, and the elastic folding flap further comprises a second bead wherein the second bead is spaced apart from the first bead.

* * * * *